US008899083B2

(12) United States Patent
Dagnino

(10) Patent No.: US 8,899,083 B2
(45) Date of Patent: Dec. 2, 2014

(54) LOCK

(76) Inventor: Federico Dagnino, Montecarlo (MC)

( * ) Notice: Subject to any disclaimer, the term of this patent is extended or adjusted under 35 U.S.C. 154(b) by 0 days.

(21) Appl. No.: 14/236,042

(22) PCT Filed: Aug. 2, 2011

(86) PCT No.: PCT/IT2011/000284
§ 371 (c)(1),
(2), (4) Date: Jan. 29, 2014

(87) PCT Pub. No.: WO2013/018113
PCT Pub. Date: Feb. 7, 2013

(65) Prior Publication Data
US 2014/0165679 A1 Jun. 19, 2014

(51) Int. Cl.
*E05B 9/04* (2006.01)
*E05B 27/00* (2006.01)
*E05B 29/00* (2006.01)

(52) U.S. Cl.
CPC ..... *E05B 27/0007* (2013.01); *E05B 29/0026* (2013.01)
USPC ..... 70/375; 70/358; 70/360; 70/419

(58) Field of Classification Search
USPC ..... 70/358, 360, 375, 419
See application file for complete search history.

(56) References Cited

U.S. PATENT DOCUMENTS

| | | | | |
|---|---|---|---|---|
| 2,648,973 | A | 8/1953 | Spain | |
| 5,263,348 | A * | 11/1993 | Wittwer | 70/379 R |
| 5,325,690 | A * | 7/1994 | Adler et al. | 70/383 |
| 5,475,997 | A * | 12/1995 | Chung | 70/375 |
| 5,893,284 | A * | 4/1999 | Hrabal | 70/358 |
| 6,058,750 | A * | 5/2000 | Li | 70/358 |
| 6,698,264 | B1 * | 3/2004 | Liao | 70/493 |
| 7,126,066 | B1 * | 10/2006 | Corcino et al. | 200/43.13 |
| 7,174,757 | B1 * | 2/2007 | Tseng | 70/358 |
| 7,444,846 | B2 * | 11/2008 | Stewart | 70/491 |
| 7,930,916 | B2 * | 4/2011 | Tamezane et al. | 70/387 |

FOREIGN PATENT DOCUMENTS

FR 1 238 928 A 8/1960

* cited by examiner

*Primary Examiner* — Suzanne Barrett
(74) *Attorney, Agent, or Firm* — Dickstein Shapiro LLP

(57) ABSTRACT

A lock (100) is described, comprising: a body (1) suitable for defining a housing (2) having a main development direction (D) along a direction of insertion (I) of the key; a first rotor (30) suitable for being rotationally housed inside said housing (2) of such a body (1) around the main development direction (D) of such a body (1), said first rotor (30) being suitable for defining a further housing to receive a second rotor (40) that can rotate inside said first rotor (30) around the main development direction (D) of such a body (1). The lock (100) is characterized in that said second rotor (40) can be rotated by the key between a position of disengagement and a position of engagement with said first rotor (30), in said position of engagement said first rotor (30) and said second rotor (40) being suitable for translating as a unit along the main development direction (D) of the body (1) to reach a position in which the lock (100) is actuated.

18 Claims, 8 Drawing Sheets

LOCK

Figure 1:
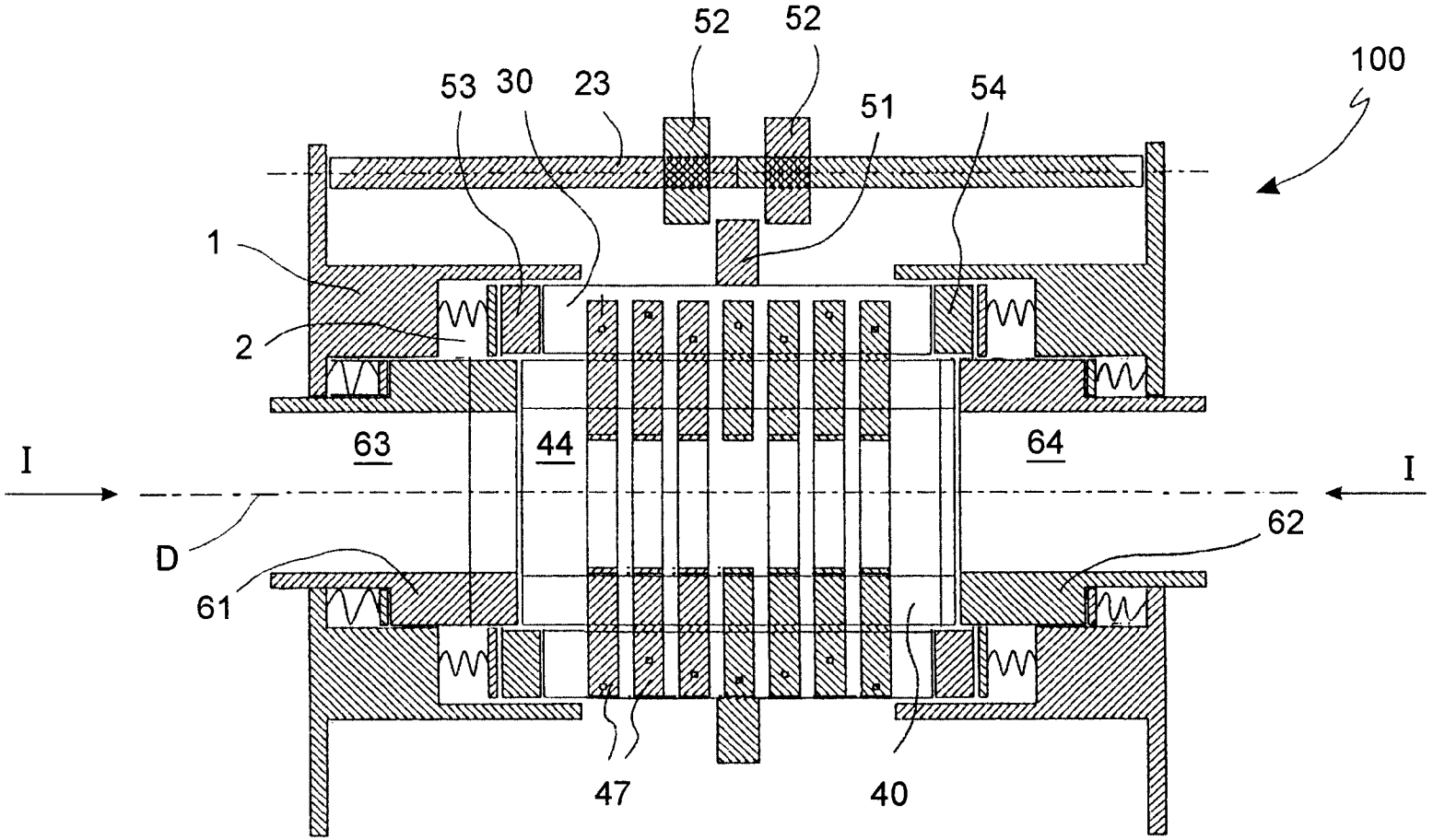

The present invention refers to a lock in particular a mechanical lock.

Mechanical locks, which can be applied to doors, windows, gates and the like, are known.

A mechanical lock of the known type has a fixed part that is suitable for housing the mechanisms of the lock and a mobile part that is equipped with a keyhole for the key to be inserted. The mobile part, which actuates the opening/closing mechanism of the lock, is blocked by pins or other means that are removed when the correct key is inserted allowing the mobile part to rotate.

For example, in a drum lock of the known type, the fixed part or stator (going from the inner surface) and the mobile part or rotor (going from the outer surface) are provided with respective radial cavities which can be aligned with one another so as to define a seat inside which a pin and a counter-pin can radially translate. Between each pin and the stator there is a spring suitable for pushing the pin and the counter-pin in a radial direction from outside inwards.

When a key is not inserted, each pin, thanks to the action of the respective spring, is inside the respective radial cavity in a position such as to inhibit the rotation of the rotor inside the stator.

When the key is inserted, the profile of the key makes it possible to move each pin and counter-pin inside the respective radial cavity, from the inside outwards, so that the lower part of the pin and the upper part of the counter-pin are aligned with the outer edge of the rotor. In such a case, by rotating the key the rotor is in turn capable of rotating inside the stator and actuating the opening/closing mechanism of the lock.

Such a mechanical lock is not without drawbacks.

Indeed, as it is known, by applying a torsional tension on the rotor, the pins and the counter-pins can incline due to the mechanical tolerances between the rotor and the pins/counter-pins and between pins/counter-pins and the stator. By lifting the counter-pins and the pins one at a time, each one moves outside the respective radial cavity and is not capable of returning into the starting position since the rotor, subjected to torsional tension, is rotated, even if only slightly, with respect to the stator. Once all the counter-pins and the pins have been made to jump outside the rotor and the stator, the rotor itself can turn freely inside the stator actuating the opening mechanism of the lock.

Such a lock-picking procedure can be applied to other mechanical locks. Indeed, it is sufficient to create a torsional tension between the fixed part (stator) and the mobile part (rotor) and exploit those mechanical tolerances between the parts of the lock which cannot be avoided during the construction and assembly of the lock itself so as to make the elements (pins, counter-pins and possibly springs), used for the actuation of the opening and closing mechanism of the lock through the key, to jump out from the radial cavities.

The mechanical lock of the prior art described above can be compromised by even directly destroying the rotor that contains the counter-pins. Once the pins have also been forcibly removed from the stator, the rotor can freely rotate with respect to the stator and actuate the opening and closing mechanism of the lock.

The purpose of the present invention is that of devising and providing a mechanical lock which makes it possible to at least partially avoid the drawbacks mentioned above with reference to the prior art.

Such a purpose is reached by means of a mechanical lock in accordance with claim 1.

Preferred embodiments of such a mechanical lock are defined in the dependent claims.

Figure 2:
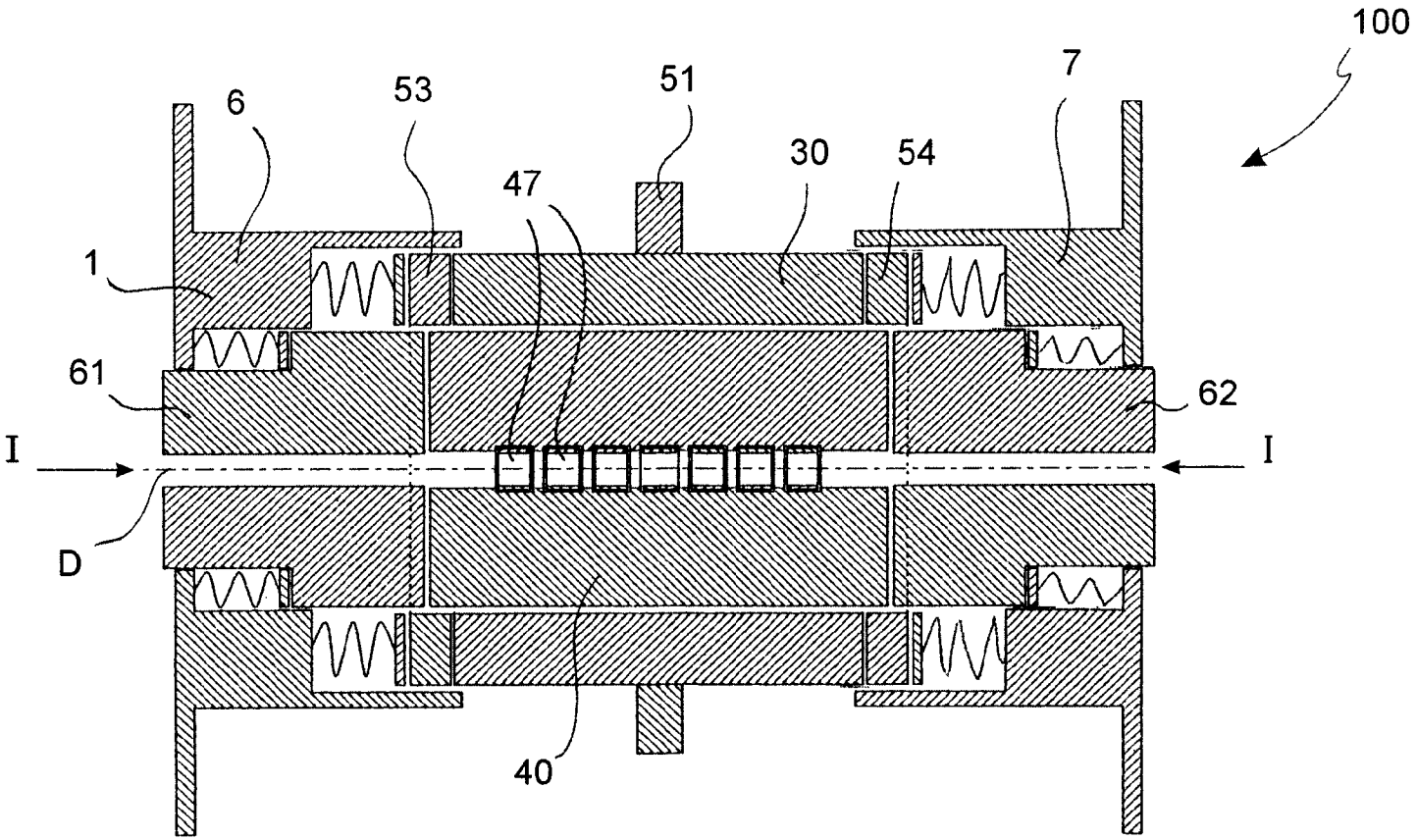
Figure 3:
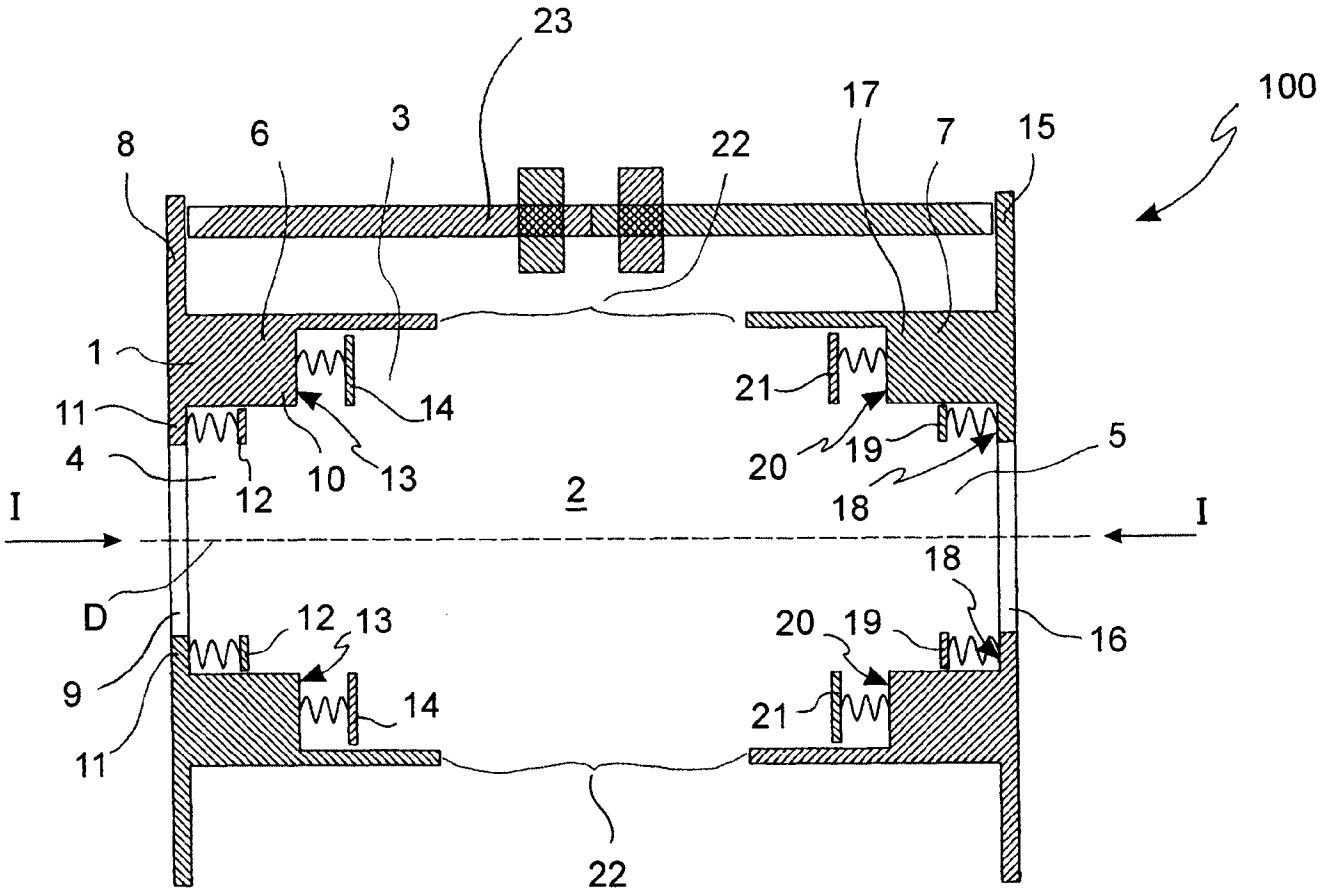
Figures 4A, 4B, 4C, 4D:
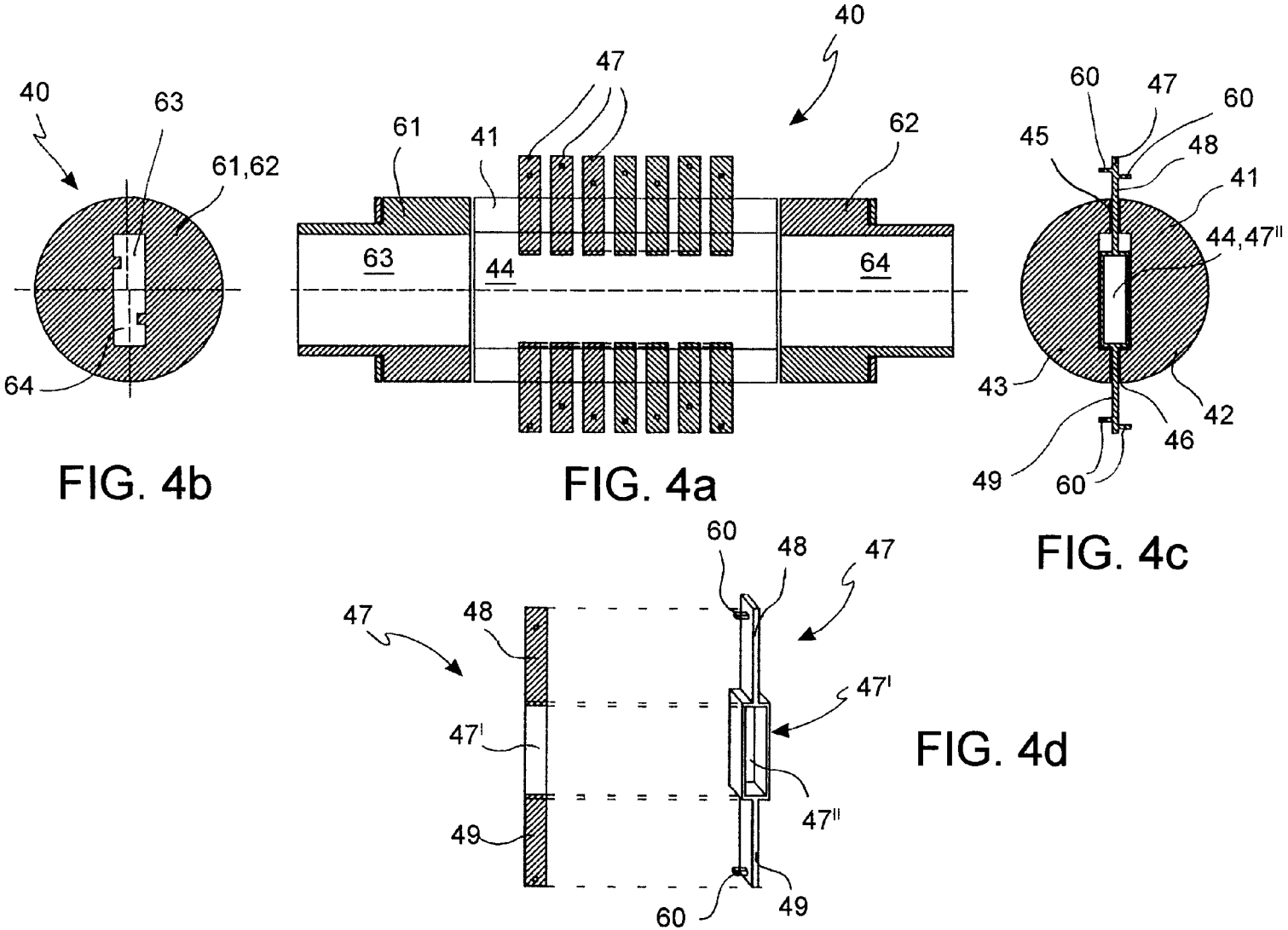

Further characteristics and advantages of the mechanical lock according to the invention shall become clearer from the following description of preferred embodiments, given as an example and not for limiting purposes, with reference to the attached figures, in which:

FIG. 1 schematically illustrates a side section view of a mechanical lock according to one embodiment of the invention with the key not inserted;

FIG. 2 schematically illustrates a top view of the mechanical lock of FIG. 1;

FIG. 3 schematically illustrates a side view of a component of the mechanical lock of FIG. 1;

FIG. 4*a* illustrates a side section view of a further component of the mechanical lock of FIG. 1;

FIG. 4*b* schematically illustrates a front view of the further component shown in FIG. 4*a;*

FIG. 4*c* schematically illustrates a cross-section view of the further component of FIG. 4*a;*

FIG. 4*d* schematically illustrates a side section and perspective view of an element of the further component of FIG. 4*a;*

Figure 5C:
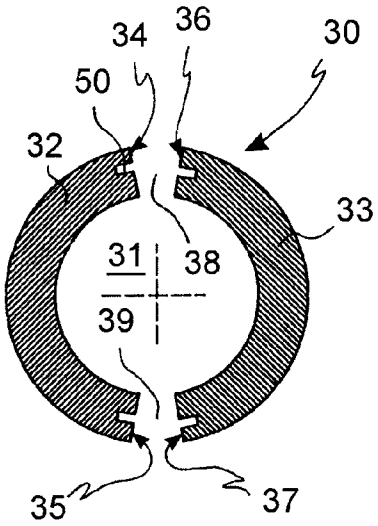
Figure 5E:
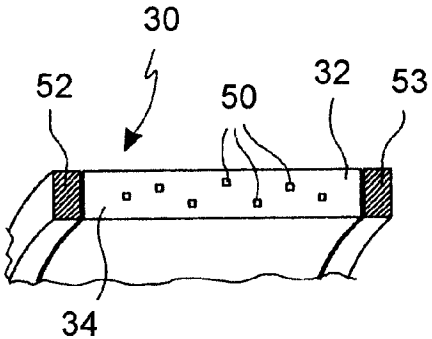
Figure 5A:
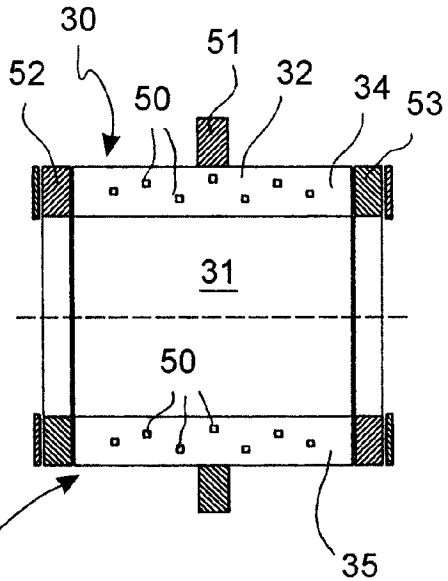
Figure 5B:
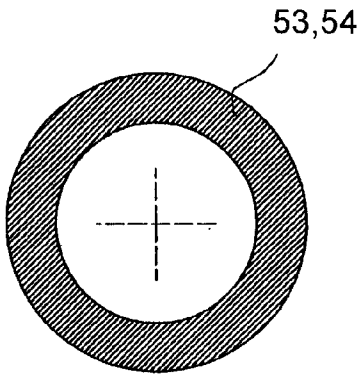
Figure 5D:
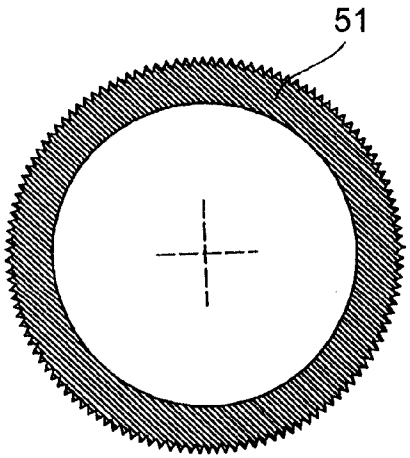

FIG. 5*a* schematically illustrates a side view of a further component of the mechanical lock of FIG. 1;

FIGS. 5*b*-5*d* schematically illustrate a front view of elements of the further component of FIG. 5*a;*

FIG. 5*e* schematically illustrates a perspective view of a portion of the further component of FIG. 5*a;*

Figure 7:
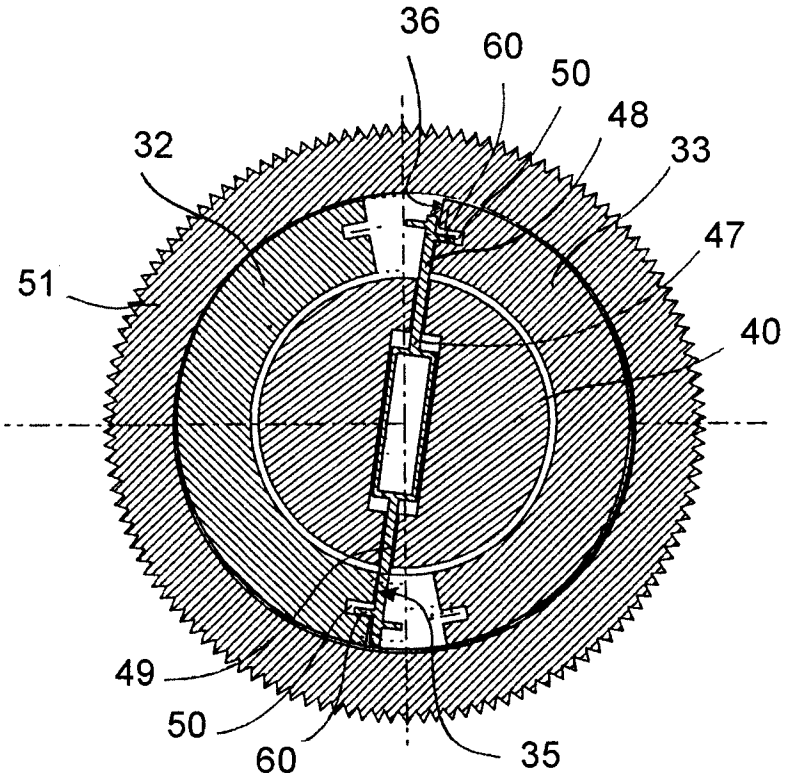
Figure 6:
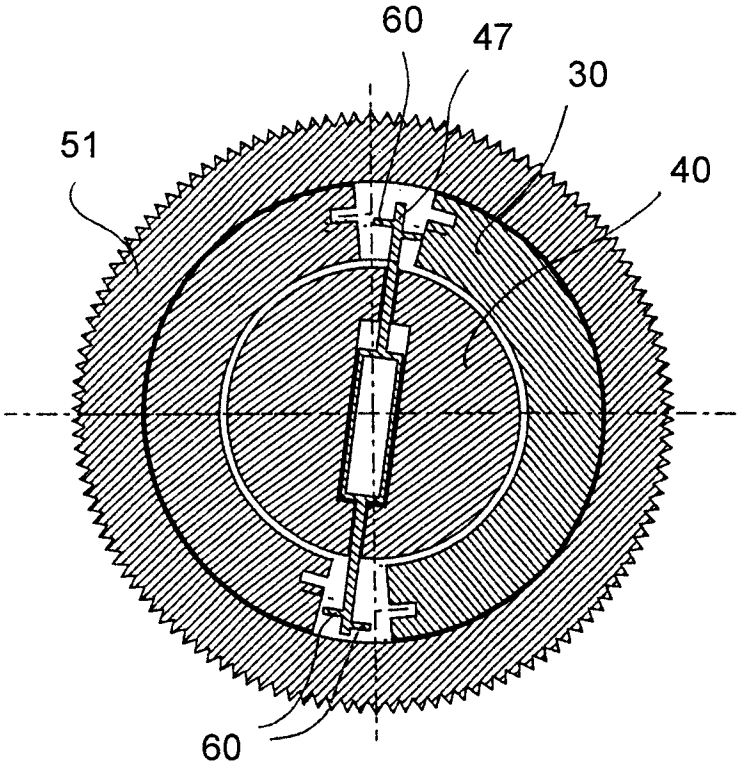
Figure 8:
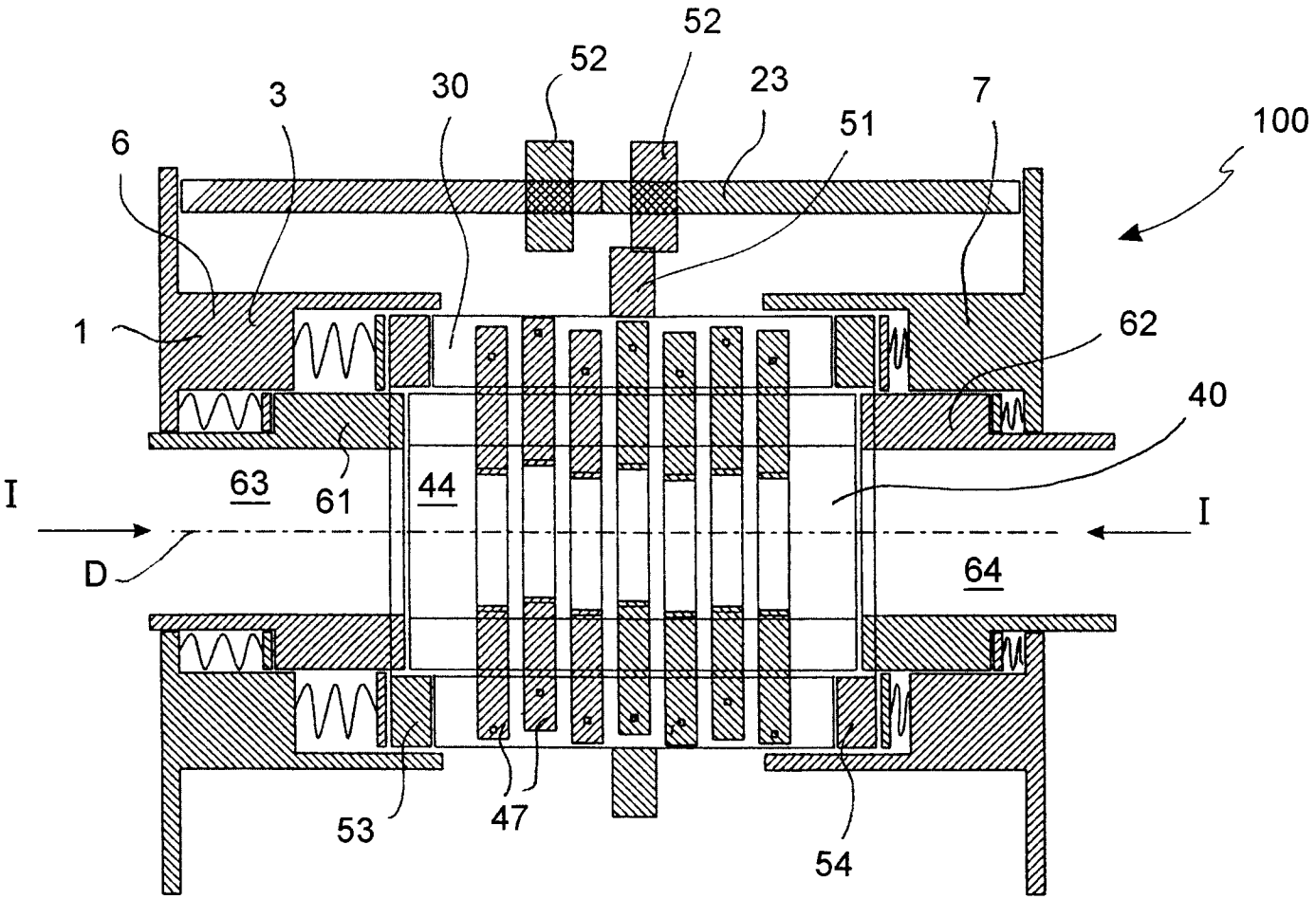
Figure 9:
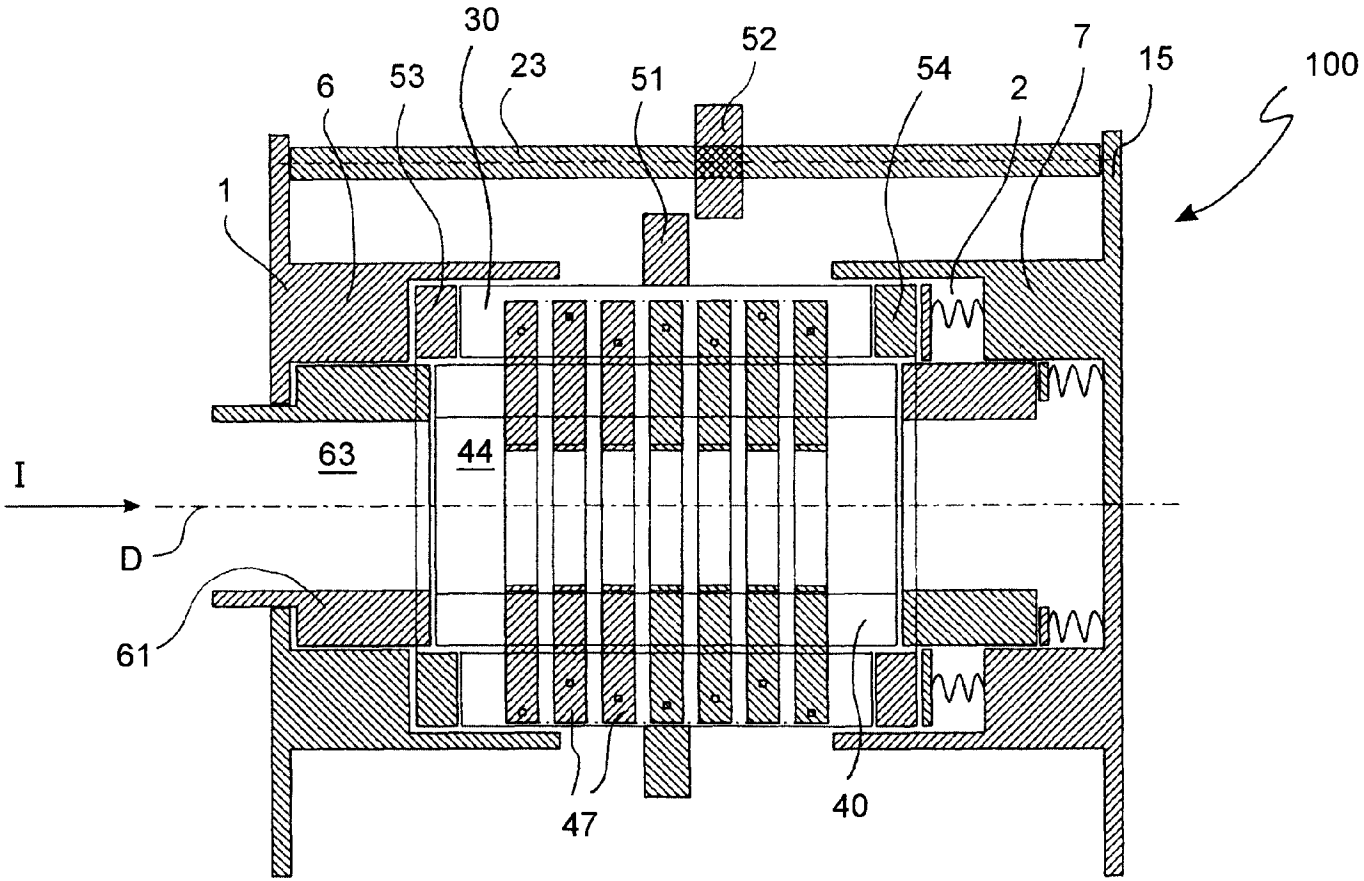

FIG. 6 schematically illustrates a front view of the mechanical lock of FIG. 1 in an operative configuration when a wrong key is inserted;

FIG. 7 schematically illustrates a front view of the mechanical lock of FIG. 1 in an operative configuration when the right key is inserted;

FIG. 8 schematically illustrates a side section view of the mechanical lock of FIG. 1 in an operative configuration with the key inserted, and FIG. 9 schematically illustrates a side section view of a mechanical lock according to a further embodiment of the invention with the key not inserted.

With reference to the aforementioned figures, a preferred embodiment of a mechanical lock, wholly indicated with reference numeral 100, shall now be described, in accordance with the present invention. Identical or similar elements and components are indicated in the figures with the same reference numerals.

It should be observed that the aforementioned mechanical lock 100, in the following also simply called lock, can be applied, in particular, to doors, gates or the like, both for indoors and for outdoors, for houses, furniture, vehicles, boats, and so on but also for portable closing devices such as padlocks.

With particular reference to FIGS. 1, 2, 3 and 8, the lock 100 comprises a body or case 1 that is suitable for defining a housing 2 having a main development direction P along a direction of insertion I of the key. For the sake of simplicity of representation, the key is not shown in the figures.

With particular reference to FIG. 2, the housing 2 of such a body 1, transverse with respect to the main development direction D, preferably has a cylindrical section. In particular, such a housing 2 comprises a central portion 3 and a first peripheral portion 4 and a second peripheral portion 5, opposite one another with respect to the central portion 3. The first peripheral portion 4 and the second peripheral portion 5 preferably have a cylindrical section with respect to the transversal direction of the main development direction D of the body 1 of the same dimension. Transversally with respect to the main direction of development D of the body 1, the central portion 3 has a larger cylindrical section with respect to the size of the cylindrical section of the first peripheral portion 4 and of the second peripheral portion 5 of the housing 2.

The body 1 comprises a first portion 6 and a second portion 7 that are shaped and opposite one another so as to define the housing 2.

In greater detail, the first portion 6 of the body 1 comprises a first peripheral wall 8 having a section that is preferably cylindrical in the direction perpendicular to the main direction of development D of the body 1. The first peripheral wall 8 has a respective opening 9 substantially arranged at the centre of the first peripheral wall 8. Such an opening 9 has a cylindrical section with smaller size with respect to the size of the cylindrical section of the first peripheral portion 4 of the housing 2.

The first portion 6 of the body 1 comprises a first inner portion 10 that extends along the main direction of development D of the body 1 towards inside the body 1. In greater detail, such a first inner portion 10, transversally with respect to the main development direction D of the body 1, from the first peripheral wall 8, internally has a peripheral cylindrical section and a central cylindrical section that are suitable for defining the first peripheral portion 4 and part of the central portion 3 of the housing 2, respectively.

It should be noted that the difference in size between the cylindrical section of the opening 9 and of the peripheral cylindrical section of the first portion 6 of the body 1 defines a first circular crown 11 for supporting positioning means 12. Such positioning means 12, the function of which shall be described in the following, comprise for example a thrusting plate that is fixed to the first circular crown through a spring or any other equivalent elastic means.

Similarly, the difference in size between the peripheral cylindrical section and the central cylindrical section of the first portion of the body 1 defines a second circular crown 13 for supporting further positioning means 14. Such further positioning means 14, the function of which shall be described in the following, comprise for example a thrusting plate that is fixed to the second circular crown through a spring or any other equivalent elastic means.

In a completely analogous way, the second portion 7 has a respective opening 9 substantially arranged at the centre of the second portion 7. Such an opening 9 has a cylindrical section with a size that is smaller with respect to the size of the cylindrical section of the second peripheral portion 5 of the housing 2.

Moreover, the second portion 7 of the body 1 comprises a second peripheral wall 15 having a section that is preferably cylindrical in a direction that is perpendicular to the main development direction D of the body 1. The second peripheral wall 15 has a respective opening 16 that is arranged substantially at the centre of the second peripheral wall 15. Such an opening 16 has a cylindrical section with a size that is smaller with respect to the size of the cylindrical section of the second peripheral portion 5 of the housing 2.

The second portion 7 of the body 1 comprises a second inner portion 17 that extends along the main development direction D towards the inside of the body 1. In greater detail, such a second inner portion 17, transversally to the main development direction D of the body 1, from the second peripheral wall 15, internally has a peripheral cylindrical section and a central cylindrical section that are suitable for defining, the second peripheral portion 5 and part of the central portion 3 of the housing 2, respectively.

It should be noted that the difference in size between the cylindrical section of the opening 16 and of the peripheral cylindrical section of the second portion 7 of the body 1 defines a first circular crown 18 for supporting positioning means 19 that are completely analogous to the positioning means 12 described previously.

Similarly, the difference in size between the cylindrical section of the peripheral cylindrical section and of the central cylindrical section of the second portion 7 of the body 1 defines a second circular crown 20 for supporting further positioning means 21, completely analogous to the positioning means 14 previously described.

It should be specified that the first portion 6 and the second portion 7 are mutually arranged with respect to the main development direction D of the body 1 so as to be substantially aligned with one another so as to define the central portion 3 of the housing 2.

For such a purpose, it should be noted that the first inner portion 10 of the first portion 6 of the body 1 and the second inner portion 17 of the second portion 7 of the body 1 have a length along the main development direction D of the body 1 such as to define a radial opening 22 of the housing 2. As shall be explained in the following, such a radial opening 22 allows the engagement of the mechanisms housed inside the body 1 with an opening/closing mechanism 23 (per se known), schematically shown in the figures, that can be actuated through the lock 100.

With particular reference now to FIGS. 1, 5*a*-5*b* and 8, the lock 100 also comprises a first rotor 30 that is suitable for being rotationally housed inside the housing 2 of the body 1 around the main development direction D of such a body 1.

Moreover, such a first rotor 30 is suitable for defining a further housing 31 so as to receive a second rotor 40 (as indicated for example in FIG. 1) that can rotate inside the first rotor 30 around the main development direction D of such a body 1. Such a second rotor 40 shall be described in the following.

It should be noted that the further housing 31 is a through cavity of the first rotor 30 inside which the second rotor 40 can rotate. The body 1 is suitable for allowing that the first rotor 30 and the second rotor 40 can rotate with respect to one another without coming into contact with one another.

The first rotor 30 is suitable for being rotationally housed inside the central portion 3 of the housing 2.

Indeed, such a first rotor 30 has, transversally with respect to the main development direction D of the body 1, a circular crown section (FIG. 5*c*) in which the greater radial dimension substantially corresponds to the radial dimension of the circular section of the central portion 3 of the housing 2.

With particular reference to FIG. 5*c*, the first rotor 30 comprises a first portion 32 and a second portion 33 each substantially C-shaped.

The first portion 32 has a first substantially radial wall 34 and a second substantially radial wall 35 extending along the main development direction D of the body 1 preferably for the entire length of the first portion 32.

In a completely analogous manner, the second portion 33 has a first substantially radial wall 36 and a second substantially radial wall 37 extending along the main development direction D of the body 1 preferably for the entire length of the second portion 33.

It should be observed that the first portion 32 and the second portion 33 are arranged with respect to one another so that the first substantially radial wall 34 and the second substantially radial wall 35 of the first portion 32 face the first substantially radial wall 36 and the second substantially radial wall 37 of the second portion 33, respectively.

Moreover, the first portion 32 and the second portion 33 are arranged in a way such as to define between the respective first substantially radial walls 34 and 36 an upper radial through opening 38 and such as to define between the respective second substantially radial walls 35 and 37 a lower radial through opening 39.

The first rotor 30 comprises a plurality of holes 50 distributed on each of the aforementioned first (34 and 36) and second (35 and 37) substantially radial walls of the first portion 32 and of the second portion 33 of the first rotor 30 (FIGS. 5*a*, 5*c* and 5*e*).

Such a plurality of holes 50 extend inside each portion of the first rotor 30 along a direction that is perpendicular to the respective substantially radial wall on which they are distributed, as clearly visible for example in FIG. 5*c*.

In a further embodiment, each of the aforementioned first (34 and 36) and second (35 and 37) substantially radial walls of the first portion 32 and of the second portion 33 of the first rotor 30 can be equipped with magnets (arranged directly on the walls or inside the plurality of holes) to temporarily hold engagement elements (described in the following) which come into abutment with such walls.

As shall be mentioned again in the following, such a plurality of holes 50 represent an encryption code of the lock 100.

With reference now to FIGS. 1, 2, 5*a*, 5*d* and 5*e*, the first rotor 30 also comprises a toothed wheel 51 suitable for engaging with a toothed wheel 52 (in the figures two toothed wheels are shown indicated with the same reference numeral 52) of the opening/closing mechanism 23 which can be actuated by the lock 100 in a respective position in which the lock is actuated, as shall be described in the following.

With reference now in particular to FIGS. 1, 5*a*, 5*b*, 5*e*, it should be noted that the first rotor 30 also comprises a first support ring 53 and a second support ring 54 that are suitable for keeping the first portion 32 and the second portion 33 of the first rotor 30 in position inside the body 1.

In greater detail, each of said first 53 and second 54 support ring have an outer radial dimension that is equal to that of the circular section of the central portion 3 of the housing 2. The internal radial dimension of such first 53 and second 54 support ring is substantially equal to the radial dimension of the first portion 32 and of the second portion 33 of the first rotor 30.

It should be noted that the first support ring 53 and the second support ring 54 are suitable for coming into abutment with the further positioning means 14 of the first portion 6 of the body 1 and the further positioning means 21 of the second portion 7 of the body 1, respectively.

With reference now to FIGS. 1, 2, 8 and in particular to FIGS. 4*a*-4*d*, the second rotor 40 of the lock 100 can rotate inside the further housing 31 defined by the first rotor 30 around the main development direction D of the body 1.

The second rotor 40 comprises a central portion 41 preferably having a cylindrical shape. Such a central portion 41 has a circular section having a radial dimension substantially equal to the radial dimension that defines the further housing 31 of the first rotor 30.

Such a central portion 41 of the second rotor 40 comprises a first part 42 and a second part 43 that are suitable for defining a central guide 44 of the key suitable for actuating the lock.

Such first part 42 and such a second part 43 of the central portion 41 are moreover shaped so as to define an upper slit 45 and a lower slit 46.

The second rotor 40 also comprises a plurality of elements for engaging 47 with the plurality of holes 50 of the first rotor 30.

As shown in particular in FIGS. 4*c* and 4*d*, each of such elements for engaging 47 comprise a central portion 47' that is suitable for being housed inside the central guide 44 of the central portion 41. Such a central portion 47' is suitable for defining a through opening 47" for the key. Moreover, each of such engagement elements 47 comprises an upper plate 48 and a lower plate 49 extending from the central portion 47' through the upper slit 45 and the lower slit 46, respectively, defined between the first part 42 and the second part 43 of the central portion 41 of the second rotor 40. In particular, as clearly visible in FIG. 1, such an upper plate 48 and such a lower plate 49 of each engagement element 47 have a length such that the free end of the upper plate 48 is arranged inside the upper radial through opening 38 defined in the first rotor 30 and the free end of the lower plate 49 is arranged inside the lower radial through opening 39 defined in the first rotor 30.

Each engagement element 47 of such a plurality is equipped with at least one pin 60 arranged on each of the surfaces of the free end of the upper plate 48 and of the free end of the lower plate 49. Each pin distributed on the plurality of elements for engaging 47 is suitable for engaging with a respective hole of the plurality of holes 40 distributed on the first rotor 30, described previously.

It should be observed that such a plurality of engagement elements 47 are representative, together with the plurality of holes 50 defined on the first rotor 30, of an encryption code of the lock 100 and each engagement element 47, in particular through the respective through opening, is suitable for interacting with the teeth of the key of the lock 100 so as to allow it to be actuated, described in the following.

In particular, each engagement element 47 of such a plurality is suitable for translating independently from one another, when pushed by the respective tooth of the key inserted, upwards or downwards in direction perpendicular to the main development direction D of the body 1 so that each pin 60 of the plurality of elements for engaging is aligned to the respective hole of the plurality of holes 50 distributed on the first rotor 30 (as shown for example in FIG. 8). In the configuration described the second rotor 40 is suitable for taking up a position of disengagement with respect to the first rotor 30.

Moreover, such a second rotor 40 can advantageously rotate through the key between the position of disengagement and a position of engagement with the first rotor.

Such a position of engagement (shown for example in FIG. 7) corresponds to the insertion of each pin 60 of the plurality of engagement elements 47 of the second rotor 40 inside the respective hole of the plurality of holes 50 distributed on the substantially radial walls of the first and second portion of the first rotor 30. In the example of FIG. 7, each pin 60 of a face of the upper free end 48 of the plurality of engagement elements 47 is inserted in the respective hole 60 of the first substantially radial wall 36 of the second portion 33 of the first rotor 30 whereas each pin 60 of a face of the lower free end 49 of the plurality of engagement elements 47 is inserted in the respective hole 60 of the second substantially radial wall 35 of the first portion 32 of the second rotor 30.

It should also be observed that advantageously in said position of engagement the first rotor 30 and the second rotor 40 are suitable for translating as a unit along the main development direction D of the body 1 to reach an actuation position of the lock.

In particular, with reference to FIGS. 1 and 2, the first rotor 30 and the second rotor 40 are suitable for translating as a unit, in said position of engagement, along the main development direction D of the body 1 so as to bring the toothed wheel 51 of the first rotor 30 to engage with the toothed wheel 52 of the opening/closing mechanism that can be actuated with the lock 100 (FIG. 8).

Again returning to the second rotor 40 of the example of the figures, it also comprises a first peripheral portion 61 and a second peripheral portion 62 opposite one another with respect to the central portion 41 of the second rotor 40 (FIG. 4*a*).

The first peripheral portion 61 of the second rotor 40 has along the main development direction D of the body 1 a shape matching that of the first inner portion 10 of the first portion 6 of the body 1.

In particular, the first peripheral portion 61 of the second rotor 40 has a shape that defines a circular crown that is suitable for coming into abutment with the positioning support means 12 of the first inner portion 10 of the first portion 6 of the body 1. Moreover, such a first peripheral portion 61 of the second rotor 40 has a free end that is preferably suitable for engaging with the opening 9 of the first peripheral wall 8 of the first portion 6 of the body 1.

The first peripheral portion 61 of the second rotor 40 is suitable for defining inside it a first peripheral guide 63 of the key (FIG. 4*b*).

In a completely analogous manner, the second peripheral portion 62 of the second rotor 40 has along the main development direction D of the body 1 a shape matching that of the second inner portion 17 of the second portion 7 of the body 1.

In particular, the second peripheral portion 62 of the second rotor 40 has a shape that defines a circular crown that is suitable for coming into abutment with the positioning support means 19 of the second inner portion 17 of the second portion 7 of the body 1. Moreover, such a second peripheral portion 62 of the second rotor 40 has a free end that is preferably suitable for engaging with the opening 16 of the second peripheral wall 15 of the second portion 7 of the body 1.

The second peripheral portion 61 of the second rotor 40 is suitable for defining inside it a second peripheral guide 64 of the key (indicated for the sake of simplicity again in FIG. 4*b*).

The first peripheral guide 63 and the central guide 44 define the overall guide of the key to actuate the lock at, for example, one side of a door facing the outside of a room. The second peripheral guide 64 and the central guide 44 define, on the other hand, the overall guide of the key to actuate the same lock 100 at, for example, the opposite side of the door facing the inside of the room.

In particular, in the first case, in the position of engagement the first rotor 30 and the second rotor 40 are translated to reach the toothed wheel of the key-actuated opening/closing mechanism 23, which is farthest away from the first peripheral guide 63 in which the key has been inserted. On the other hand, in the second case, in the position of engagement the first rotor 30 and the second rotor 40 are translated forwards so as to reach the toothed wheel of the key-actuated opening/closing mechanism 23, which is farthest away from the second peripheral guide 64 in which the key has been inserted.

It should moreover be noted that the positioning means and the further positioning means previously described allow both the first rotor 30 and the second rotor 40, as a unit or independently from one another (in the mutual position of disengagement), to return, thanks for example to the action of the springs, into a central position inside the housing 31 and of the further housing 44, respectively, for example for disengaging the toothed wheel 51 of the first rotor 30 from the toothed wheel 52 engaged so as to actuate the opening/closing mechanism.

Moreover, it should be noted that each plate which the positioning means and the further positioning means are equipped with advantageously make it possible to reduce the friction of the first rotor 30 and of the second rotor 40 when these are in rotation.

In a further embodiment illustrated in FIG. 9, the lock 100 can be suitable for having only one peripheral guide for the insertion of the key for the actuation of the mechanism of the lock.

In greater detail, such a lock comprises a body or case 1 comprising a first portion 6 completely analogous to that described previously with reference to the lock of the example of FIG. 1, except for the fact that it does not have the respective positioning means and further positioning means.

Such a body 1 also comprises a second portion 7, opposite the first portion 6 with respect to the housing of the body 1, completely analogous to the second portion 7 described previously with reference to the lock of the example of FIG. 1, except that the second peripheral wall 15 does not have any through opening.

The lock 100 of FIG. 9 comprises a first rotor 30 and a second rotor 40 that are completely analogous to those described previously with reference to the lock of FIG. 1.

It should also be noted that the opening/closing mechanism 23 that can be actuated with the lock 100 of FIG. 9 is preferably equipped with a single toothed wheel 52 that is suitable for engaging with the toothed wheel 51 of the first rotor 30.

The lock 100 of the further example of FIG. 9 is substantially a lock equipped with a single peripheral guide for the key to be inserted in.

Such a type of lock can be applied for example to a door, gates or the like that require having a single side to be opened through a key (the other side could be pushed through a handle) or in portable devices that usually have a single keyhole for the key, such as for example padlocks.

Finally, it should be specified that all the elements and/or components of the lock 100 according to the examples previously described can be manufactured in any convenient material, for example metal and/or metal alloys.

With reference now to FIGS. 1-8, we shall now briefly describe an example of operation of the lock 100 according to the first embodiment described.

When the key is inserted inside the peripheral guide 63 and the central guide 44, each engagement element of the plurality of elements for engaging 47 translates independently from one another upwards or downwards in direction perpendicular to the main development direction D of the body 1 after the engagement of each tooth of the key with the central guide 44 defined inside each engagement element 47.

Following the aforementioned translation, each pin 60 arranged on a face of the upper free end 48 and of the lower free end 49 of each engagement element 47 is aligned with the respective hole 50 of the plurality of holes 50 distributed on the first and second radial walls defined by the first portion 32 and by the second portion 33 of the first rotor 30. When the key is inserted, the second rotor 40 and the first rotor 30 are in a mutual position of disengagement.

At this point, by slightly rotating the key, towards the right or towards the left, each pin 60 of a surface of the upper free end 48 and of the lower free end 49 of each engagement element 47 is inserted inside the respective hole 50 which it was facing in the so called position of disengagement of the second rotor 40 with respect to the first rotor 30. In such a way, the second rotor 40 is rotated from the position of disengagement to an position of engagement with the first rotor 30 (FIG. 7).

In the case in which there are magnets inside each hole or on each radial wall of the first rotor 30, the second rotor 40 is capable of advantageously maintaining the position of engagement with the first rotor 30.

At this point, by exerting a thrust with the key, the second rotor 40 and the first rotor 30 are translated as a unit along the main development direction D of the body 1 so as to reach the position in which the lock 100 is actuated, or rather when the toothed wheel 51 of the first rotor 30 engages with the toothed wheel 52 of the opening/closing mechanism 23 that can be actuated with the lock 100 (FIG. 8).

At this moment, by completely rotating the key, there is the actuation of the opening/closing mechanism and the consequent opening/closing movement of the door, gate or the like on which the lock 100 is mounted.

By extracting the key, the further positioning means again translate the first rotor 30 along the main development direction D of the body 1 from the position of actuation to a position of non-actuation of the lock 100, or rather a position in which the toothed wheel 51 of the first rotor 30 does not engage with any toothed wheel 52 of the opening/closing mechanism. Moreover, when the key is taken out, the positioning means also translate the second rotor 40 along the main development direction D of the body 2 towards a position of non-actuation of the lock 100.

Contextually, the second rotor 40 rotates inside the further housing 44 defined by the first rotor 30 from the position of engagement to the position of disengagement and if the key is not there, the plurality of engagement elements 47 translates downwards through gravity until it comes into abutment with the lower part of the through opening 47" defined by the second rotor 40 (FIG. 7).

In the configuration just described, or rather the first rotor 30 in the position of non-actuation of the lock 100 and the plurality of engagement elements 47 translated downwards, any attempt to rotate with any means that is not the right key the second rotor 40 inside the first rotor 30 simply causes an idle rotation of the second rotor 40 as a unit with the first rotor 30. Indeed, without the right key it is not possible to engage the second rotor 40 and the first rotor 30 with one another so as to be able to both translate as a unit to reach the position in which the lock 100 is actuated.

As can be seen, the purpose of the present invention is fully achieved since the mechanical lock of the invention has less possibility of being picked with the current methods used for picking locks described with reference to the prior art.

Indeed, without the insertion of the correct key, the first rotor 30 and the second rotor 40 can freely rotate inside the respective housings.

Again, it is not possible to keep the first rotor 30 and the second rotor 40 in tension to move each engagement element 47, one at a time, so as to align and insert each pin with which the second rotor 40 is equipped, in the respective hole 60 arranged on the first rotor 30. Indeed, any attempt to rotate the second rotor 40 will only have the effect of the simultaneous rotation of the first rotor 30 because at least one pin of the second rotor 40 will come into abutment on one of the radial walls defined in the first rotor 30.

Moreover, the fact that no pin of the second rotor 40 can be inserted, independently from the other pins, inside the respective hole distributed on the first rotor 30, the translation along the main development direction D of the body 1 of the second rotor 40 does not produce any translation in the same direction of the first rotor 30 and consequently it is not possible for the toothed wheel 51 of the first rotor 30 to reach the toothed wheel 52 of the opening/closing mechanism 23 that can be actuated with the lock 100 so as to proceed to opening the lock 100.

Moreover, the forced destruction of the plurality of engagement elements 47 would result in their falling which would no longer be capable to engage with the plurality of holes 50 to actuate the mechanism of the lock of the invention.

Moreover, it should be reminded that the independent rotation of the first rotor 30 and of the second rotor 40 advantageously allows both the rotors to not maintain a mutual torsional tension that could be exploited to pick the lock.

A man skilled in the art, in order to satisfy contingent requirements, may carry out modifications, adaptations and replacements of elements with other ones that are functionally equivalent to the embodiments of the lock described above, without for this reason departing from the following claims. Each of the characteristics described as belonging to a possible embodiment can be made independently from the other embodiments described.

The invention claimed is:

1. Lock comprising:

a body including a housing having a longitudinal axis along a direction of insertion of the key;

a first rotor rotationally disposed inside said housing of said body around the longitudinal axis of said body, said first rotor including a further housing for receiving a second rotor that can rotate inside said first rotor around the longitudinal axis of said body, wherein said second rotor is rotatable by the key between a position of disengagement and a position of engagement with said first rotor, and wherein, when said second rotor is in said position of engagement with said first rotor, said first rotor and said second rotor translate together as a unit along the longitudinal axis of the body to reach a position in which the lock is actuated.

2. Lock according to claim 1, wherein the first rotor comprises a first portion and a second portion having a C-shaped section.

3. Lock according to claim 1, wherein said first portion comprises a first substantially radial wall and a second substantially radial wall extending along the longitudinal axis of the body.

4. Lock according to claim 3, wherein said second portion comprises a first substantially radial wall and a second substantially radial wall extending along the longitudinal axis of the body.

5. Lock according to claim 4, wherein such a first portion and such a second portion are arranged in a way such as to define an upper radial opening between the respective first substantially radial walls and a lower radial opening between the respective second substantially radial walls.

6. Lock according to claim 5, wherein said first rotor comprises a plurality of holes distributed on each of the first substantially radial walls and on each of the second substantially radial walls of the first portion and of the second portion of the first rotor, said plurality of holes representing an encryption code of the lock.

7. Lock according to claim 1, wherein the first rotor further comprises a toothed wheel suitable for engaging with a toothed wheel of an opening/closing mechanism which can be actuated by the lock.

8. Lock according to claim 2, wherein the first rotor further also comprises a first support ring and a second support ring suitable for keeping the first portion and the second portion of the first rotor in position inside the body.

9. Lock according to claim 1, wherein the second rotor comprises a central portion, said central portion comprising a first part and a second part defining a central guide of the key for actuating the lock.

10. Lock according to claim 9, wherein said first part and said second part of the central portion of the second rotor include an upper slit and a lower slit.

11. Lock according to claim 10, wherein the second rotor comprises a plurality of elements for engaging with said plurality of holes of the first rotor, said plurality of engagement elements being representative of the encryption code of the key for actuating the lock.

12. Lock according to claim 11, wherein each of the engagement elements comprises a central portion housed inside the central guide of the central portion of the second rotor, said central portion defining an opening for the key.

13. Lock according to claim 12, wherein each of the engagement elements also comprises an upper plate and a lower plate extending from the central portion through the upper slit and the lower slit, respectively, between the first part and the second part of the central portion of the second rotor.

14. Lock according to claim 13, wherein the free end of the upper plate of the engagement element is arranged inside the upper radial opening in the first rotor, the free end of the lower plate of the engagement element being arranged inside the lower radial opening in the first rotor.

15. Lock according to claim 14, wherein each engagement element is equipped with at least one pin arranged on each of the surfaces of the free end of the upper plate and of the free end of the lower plate, each pin distributed on the plurality of engagement elements for engaging with a respective hole of the plurality of holes distributed on the first rotor.

16. Lock according to claim 15, wherein each engagement element translates independently of the other engagement elements, pushed by a respective tooth of the key inserted in the central guide of the second rotor, upwards or downwards along a direction that is perpendicular to the longitudinal axis of the body, so that each pin of the plurality of engagement elements aligns with the respective hole of the plurality of holes distributed on the first rotor .

17. Lock according to claim 16, wherein the second rotor also comprises a first peripheral portion and a second peripheral portion opposite one another with respect to the central portion of the second rotor.

18. Lock according to claim 17, wherein the first peripheral portion of the second rotor includes a first peripheral guide of the key, the second peripheral portion of the second rotor including a second peripheral guide of the key.

* * * * *